US006033112A

United States Patent [19]

Sorenson et al.

[11] Patent Number: 6,033,112

[45] Date of Patent: Mar. 7, 2000

[54] UNIVERSAL FLEXIBLE PACKAGING BAG

[75] Inventors: Jesse Paul Sorenson, Little Chute; Jack Lee Couillard, Menasha, both of Wis.; William Joseph Meyer, Paris, Tex.; Gregory Allen MacDonald, Neenah; Michael Andrew Machurick, Little Chute, both of Wis.; Glenn Chance Dunlap, III, Terre Haute, Ind.; Aric Anton Melzl, Paris, Tex.

[73] Assignee: Kimberly-Clark Worldwide, Inc., Neenah, Wis.

[21] Appl. No.: 09/296,867

[22] Filed: Apr. 22, 1999

Related U.S. Application Data

[62] Division of application No. 09/052,719, Mar. 31, 1998, Pat. No. 5,941,639

[60] Provisional application No. 60/068,800, Dec. 24, 1997.

[51] Int. Cl.[7] ..... B65D 33/14

[52] U.S. Cl. ..... 383/9; 383/35; 383/37; 383/106; 206/554

[58] Field of Search ..... 383/8, 9, 35, 37, 383/76, 86.2, 106; 206/554

[56] References Cited

U.S. PATENT DOCUMENTS

| | | | |
|---|---|---|---|
| 1,411,774 | 4/1922 | Engel . | |
| 2,115,281 | 4/1938 | Potdevin . | |
| 2,790,591 | 4/1957 | Rosen . | |
| 3,044,233 | 7/1962 | Altman, Jr. . | |
| 3,196,728 | 7/1965 | Snow . | |
| 3,249,285 | 5/1966 | Dollheimer et al. . | |
| 3,312,339 | 4/1967 | Million . | |
| 3,317,037 | 5/1967 | Russell . | |
| 3,336,845 | 8/1967 | Lepisto et al. . | |
| 3,380,579 | 4/1968 | Pinto | 206/554 X |
| 3,482,761 | 12/1969 | Suominen et al. | 383/8 |
| 3,605,571 | 9/1971 | Titchenal | 206/554 X |
| 3,640,450 | 2/1972 | Lieberman . | |
| 3,646,723 | 3/1972 | Meroney . | |
| 3,804,322 | 4/1974 | Ericson . | |

(List continued on next page.)

FOREIGN PATENT DOCUMENTS

| | | | |
|---|---|---|---|
| 851553 | 9/1970 | Canada | 206/554 |
| 862578 | 2/1971 | Canada . | |
| 966453 | 4/1975 | Canada . | |
| 1085788 | 9/1980 | Canada . | |
| 1269954 | 6/1990 | Canada . | |
| 1284969 | 6/1991 | Canada . | |
| 1295295 | 2/1992 | Canada . | |
| 1299531 | 4/1992 | Canada . | |
| 1310217 | 11/1992 | Canada . | |
| 2070919 A1 | 12/1992 | Canada . | |
| 1958690 | 5/1971 | Germany | 206/554 |
| 2803961 | 8/1978 | Germany | 206/554 |
| 3831823 | 3/1990 | Germany | 206/554 |
| WO 93/15959 A1 | 8/1993 | WIPO . | |

OTHER PUBLICATIONS

American Society for Testing Materials (ASTM) Designation: D 2244–85, "Standard Test Method for Calculation Of Color Differences From Instrumentally Measured Color Coordinates," pp. 388–393, published Jan. 1986.

*Primary Examiner*—Jes F. Pascua
*Attorney, Agent, or Firm*—Thomas M. Gage; Douglas L. Miller

[57] ABSTRACT

A universal flexible packaging bag is provided that contains a stack of products, such as a plurality of disposable absorbent training pants, in which each product has a component, such as a graphic on a front panel of a training pant, that is to be visually perceived through a window in the bag. The bag is uniquely designed to accommodate differently designed bagging machines, such as a right-handed bagging machine and a left-handed bagging machine, so that a stack of products can be positioned in the bag such that the component is visible through the window.

9 Claims, 8 Drawing Sheets

U.S. PATENT DOCUMENTS

| | | | |
|---|---|---|---|
| 4,106,733 | 8/1978 | Walitalo | 383/76 X |
| 4,106,734 | 8/1978 | Walitalo . | |
| 4,277,930 | 7/1981 | Nausedas et al. . | |
| 4,669,251 | 6/1987 | Inagaki . | |
| 4,676,378 | 6/1987 | Baxley et al. . | |
| 4,759,639 | 7/1988 | DeMatteis | 383/9 X |
| 4,779,996 | 10/1988 | Sengewald . | |
| 4,785,938 | 11/1988 | Benoit, Jr. et al. . | |
| 4,790,437 | 12/1988 | Pistner | 383/8 X |
| 4,811,417 | 3/1989 | Prince et al. . | |
| 4,811,418 | 3/1989 | Reifenhauser | 206/554 X |
| 4,840,610 | 6/1989 | Pistner . | |
| 4,974,968 | 12/1990 | Mandus et al. . | |
| 4,989,732 | 2/1991 | Smith . | |
| 5,062,716 | 11/1991 | Conrad et al. | 206/554 X |
| 5,074,674 | 12/1991 | Kuklies et al. . | |
| 5,183,158 | 2/1993 | Boyd et al. . | |
| 5,282,687 | 2/1994 | Yee . | |
| 5,326,575 | 7/1994 | Spaulding . | |
| 5,457,944 | 10/1995 | Lipes . | |
| 5,507,713 | 4/1996 | Glod, Sr. et al. . | |
| 5,611,627 | 3/1997 | Belias et al. | 383/37 |
| 5,670,013 | 9/1997 | Huang et al. | 206/554 X |

UNIVERSAL FLEXIBLE PACKAGING BAG

This application is a divisional of application Ser. No. 09/052,719 entitled UNIVERSAL FLEXIBLE PACKAGING BAG and filed in the U.S. Patent and Trademark Office on Mar. 31, 1998, now U.S. Pat. No. 5,941,639. The entirety of application Ser. No. 09/052,719 is hereby incorporated by reference, which application claims priority from U.S. Provisional Application No. 60/068,800 filed Dec. 24, 1997.

BACKGROUND OF THE INVENTION

The present invention relates to packaging bags, and more particularly to universal flexible packaging bags for use with differently designed bagging machines.

Bags used in automated filling processes have been known for many years. Traditionally, these bags are produced from continuous sheets or rolls of bag material, typically organic or other plastic material. In many manufacturing processes, a sheet of bag material is folded and sealed to form a continuous flat bag tube having an upper and lower layer. This tube may be further folded or pinched to form multiple layers in, for example, side gusseted bags. The tube may then be again sealed, cut, stamped, separated, and stacked on storage wickets for subsequent use in the automated bag filling operation. Storage wickets onto which the newly formed bags are stacked are typically U-shaped pieces of thin rigid material, which fit through aligned wicket openings formed in the bags on the stack.

During bag filling, stacks of bags are transferred from the wickets onto mandrels which make up part of a bag filling mechanism. After the wicket is removed, the bags remain aligned and stacked on the mandrels. Typically, caps are then positioned over the exposed end of each filling mandrel thereby holding the stacked bags in formation so that they may be used in the filling operation.

During the bag loading process, suction cups or other grabbing means separate the upper layer of the bag from the lower layer, thereby initiating the opening of the bag. A jet or puff of air delivered through needle and check valve arrangements further opens the bag while the lower layer of the bag remains securely positioned on the filling mandrels. As the bag opens, loader arms unfold within the filling edge of the bag which open the bag completely, while a filling arm pushes items into the bag and ultimately pushes the filled bag off of the mandrel.

While wicketed bags represent a popular choice among manufactures in automated filling operations, such bags share a number of problems which have not been satisfactorily addressed at this time. One such problem stems from the difficulties associated with different types of bag opening and filling mechanisms. These bag opening and filling mechanisms can have various designs that can include differently shaped or designed parts or devices that handle the bags in a different manner. Thus, a bag that is designed and manufactured for one particular machine cannot be used on a differently designed machine that has parts or devices that prevent proper handling of the bag, such as, by way of example only, properly loading a wicket of bags on the machine, properly opening the bag, maintaining the bag in place during the filling process, pushing the bag out of the machine after it has been filled, or the like.

Due to the existence of differently designed bag filling mechanisms, an accompanying problem is the necessity of having to maintain dual, or more, inventories of items for differently designed mechanisms. This is costly because of having to purchase different bag designs and increased storage requirements.

In addition, known bags used in automated filling operations are problematic because of the substantial and non-uniform forces required to push the filled bag off the mandrel after loading. These forces, typically generated by the filling arm, involve breaking through a portion of the bag material between the wicket opening and the edge of the bag. Depending on the particular bag material being used, the force necessary to start the break, i.e., the initiation force, will vary substantially as the thickness and width of the material to be torn varies. In addition, the distance between the wicket opening and the filling edge of the bag, i.e., the width of the material to be torn, may vary in production bags, due in part to registration or positioning problems which may occur when the wicket opening and other cuts are made. As a result, the forces required to fill the bag, initiate the break and to continue the break, i.e., the propagation force, may vary not only from bag to bag, but within a given bag. These variations require different forces to be applied for different periods of time in order to fill the bag and ultimately push it off the mandrel at the appropriate time, which is after the bag is filled. The variations in forces can be extremely significant for certain types of bag materials such as, by way of example, low density polyethylene which has a propagation force curve which increases with the stretching of the material until a tear threshold is reached which occurs as the bag is pushed off the mandrel.

Yet another problem associated with wicketed bags of known construction is that the forces require to tear them from the filling mandrel often cause unwanted shards or fragments of bag material to tear and separate from the bag. These fragments are problematic in at least two ways. Loose fragments of material in a filled package are aesthetically unacceptable, and may be a safety hazard. Furthermore, these fragments of torn material often get caught and jam the bag filling mechanism causing significant downtime and increased cost of manufacturer.

SUMMARY OF THE INVENTION

In response to the discussed difficulties and problems encountered in the prior art, universal flexible packaging bags have been discovered.

One form of the present invention, there is provided a flexible packaging bag comprising a top layer having four holes positioned to form an outer pair of holes and an inner pair of holes, a bottom layer having four holes positioned to form an outer pair of holes and an inner pair of holes, a bag opening, and a bag window. The top layer also has slits extending between the outer pair of holes and the bag opening, and tear notches associated with the inner pair of holes and directed toward the outer pair of holes. The bottom layer also has tear notches associated with the outer pair of holes and directed toward the inner pair of holes, and slits extending between the inner pair of holes and the bag opening.

In another form of the present invention, there is provided a flexible packaging bag comprising a top layer having four holes positioned to form an outer pair of holes and an inner pair of holes, a bottom layer comprising four holes positioned to form an outer pair of holes and an inner pair of holes, a bag opening, a bag window positioned partially in the top and partially in the bottom layer, slits extending between the outer pair of holes of either the top layer or the bottom layer and the bag opening, and tear notches associated with the outer pair of holes of the other of the top layer or bottom layer, and slits extending between the inner pair of holes of either the top layer or the bottom layer and the bag opening, and tear notches associated with the inner pair of holes of the other of the top layer or bottom layer.

In yet another form of the present invention, there is provided a flexible packaging bag comprising a top layer, a bottom layer, a bag opening, and a bag window positioned partially in the top layer and partially in the bottom layer. The top layer has a pair of holes spaced apart a first distance, and a pair of corner cutouts adjacent the bag opening. The bottom layer has a pair of holes spaced apart a second distance that is greater than the first distance, and a cutout adjacent the bag opening and between the pair of holes.

In still yet another form of the present invention, there is provided a flexible packaging bag comprising a top layer and a bottom layer, a bag opening, and a bag window. One of the top layer and bottom layer has a pair of holes spaced apart a first distance and corner cutouts adjacent the bag opening. The other of the top layer and bottom layer has a pair of holes spaced apart a second distance and a cutout between the pair of holes.

BRIEF DESCRIPTION OF THE DRAWINGS

The above-mentioned and other features of the present invention and the manner of obtaining them will become more apparent, and the invention itself will be better understood by reference to the following description of the invention taking in conjunction with the accompanying drawings wherein.

DETAILED DESCRIPTION

Variously designed bagging machines are currently available for purchase from either a single manufacturer or multiple manufacturers. One design feature that may differ between machines can result in a different orientation of a stack of products just prior to the stack of products being moved or pushed into an open bag. To date, this has not caused a problem in the filling and packaging of a flexible packaging bag, since the orientation of a stack of products in the bag was of no concern or no significance. This has changed, however, upon the requirement of having a portion of a product, such as, by way of example only, a graphic, to be visually displayed through a clear window in the bag. The term "graphic" can refer, but is not limited, to an image, design, pattern, symbology, edition, or the like, and a graphic is just one type of component that may be desired to be visually perceived through the window in the bag. The term "component" can also refer, but is not limited, to all or a segment of a designated selected region of the product, such as edges, corners, sides or the like; and structural members such as elastic strips, absorbent pads, elastic layers or panels, layers of material, or the like. The term "clear" in reference to the window refers to a material capability of transmitting light so that the component, or a portion thereof, can be seen as if there were no intervening material between the component and the viewer. For example, a material is "clear", "substantially clear", or the like when light readily passes therethrough, such that a component, for example, can be viewed by the eye. A material can be considered to be "clear", "substantially clear", or the like when it has a light transmission greater than about 50%, desirable greater than about 80% and more desirable greater than about 90%. The light transmission of a material can be suitably determined by BYK Gardener as set forth in ASTM-D 2244-85.

Figure 3:
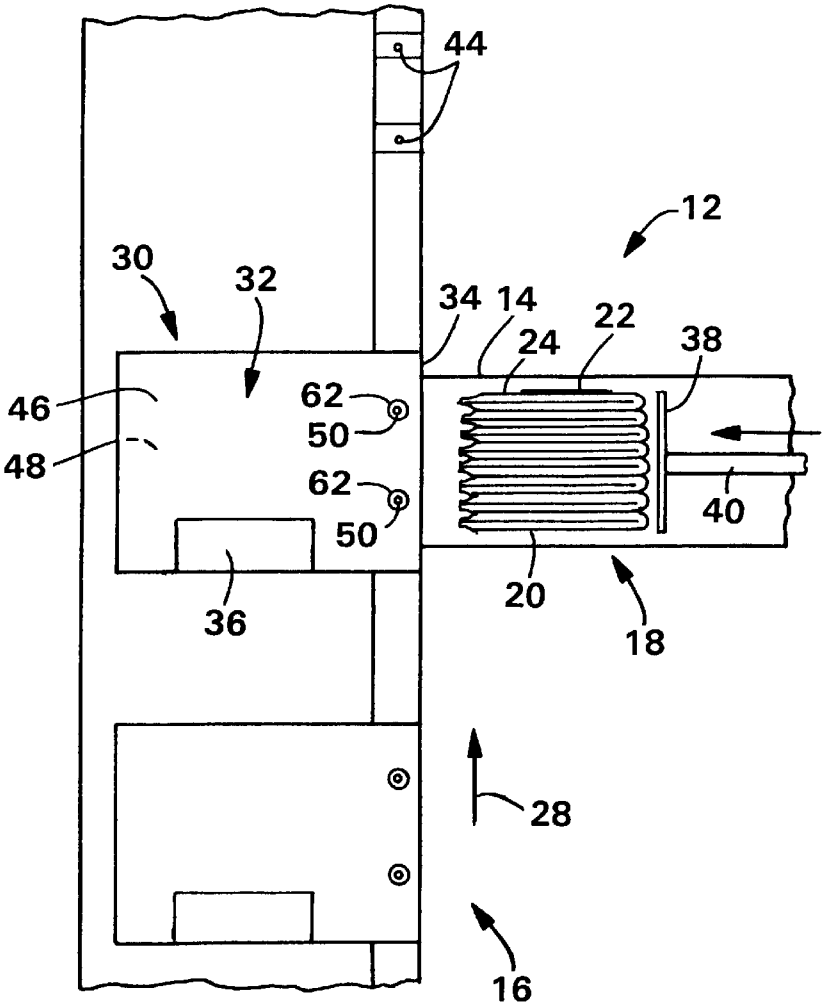
FIG. 3 illustrates a fragmentary top elevational view of a right-handed bagging machine with the bag of FIG. 1.
Figure 2:
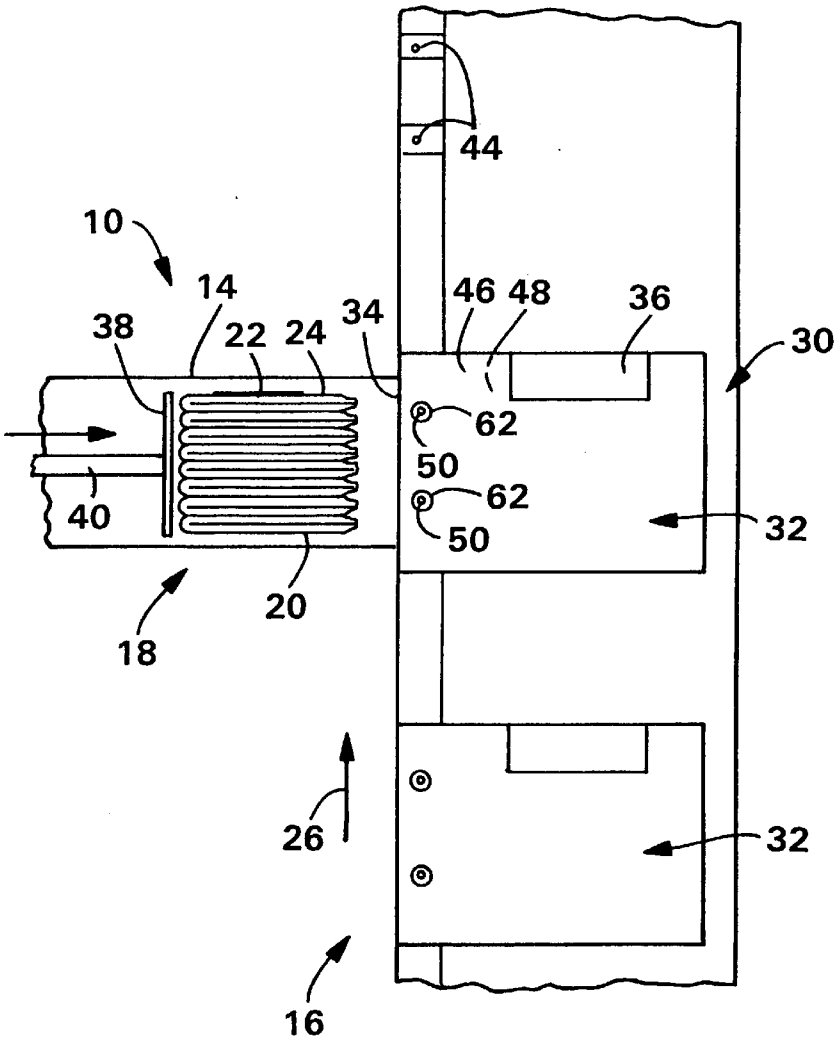
FIG. 2 illustrates a fragmentary top elevational view of a left-handed bagging machine with the bag of FIG. 1.
Figure 9:
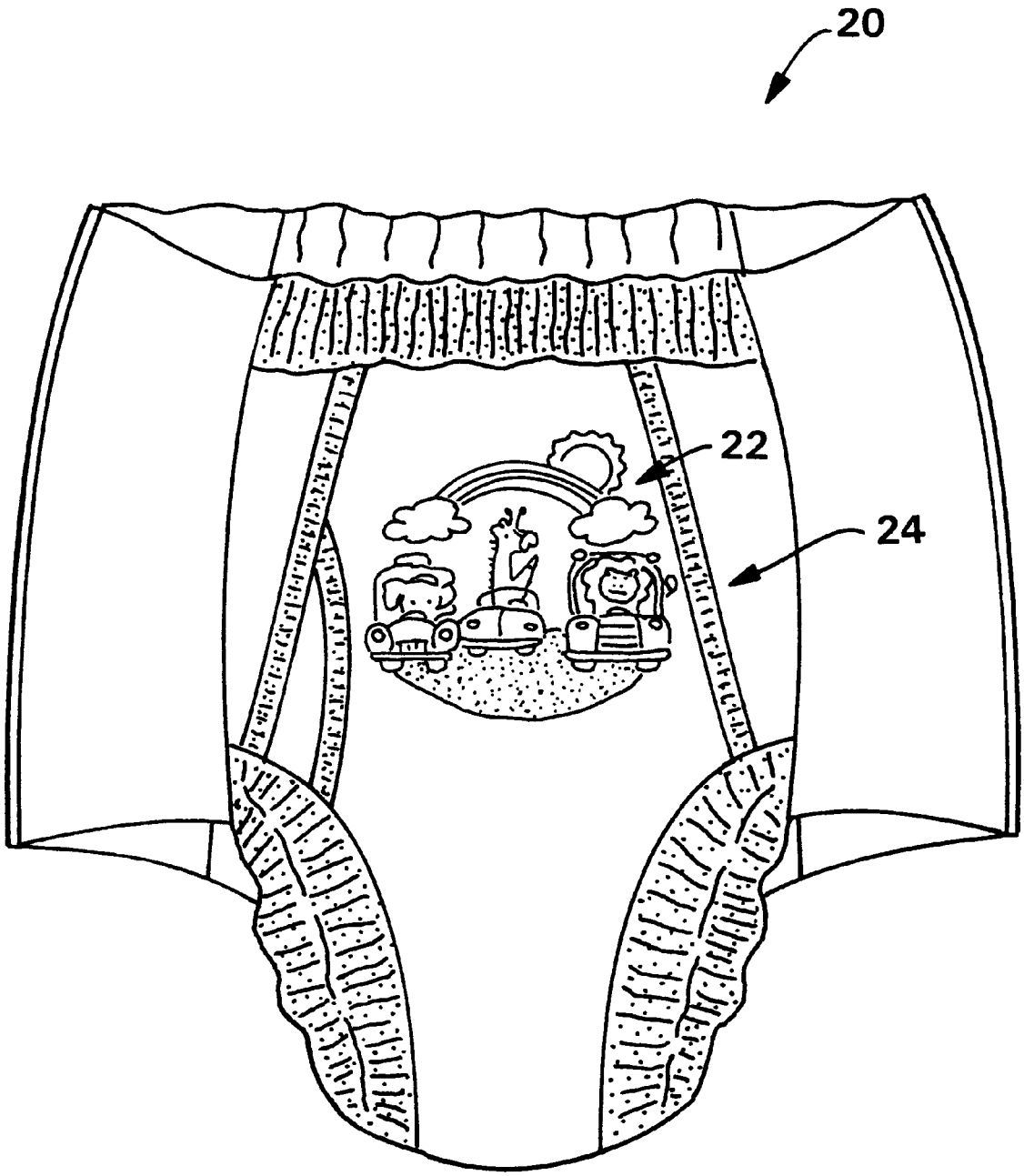
FIG. 9 illustrates a front elevational view of a training pant with a graphic.
Figure 10:
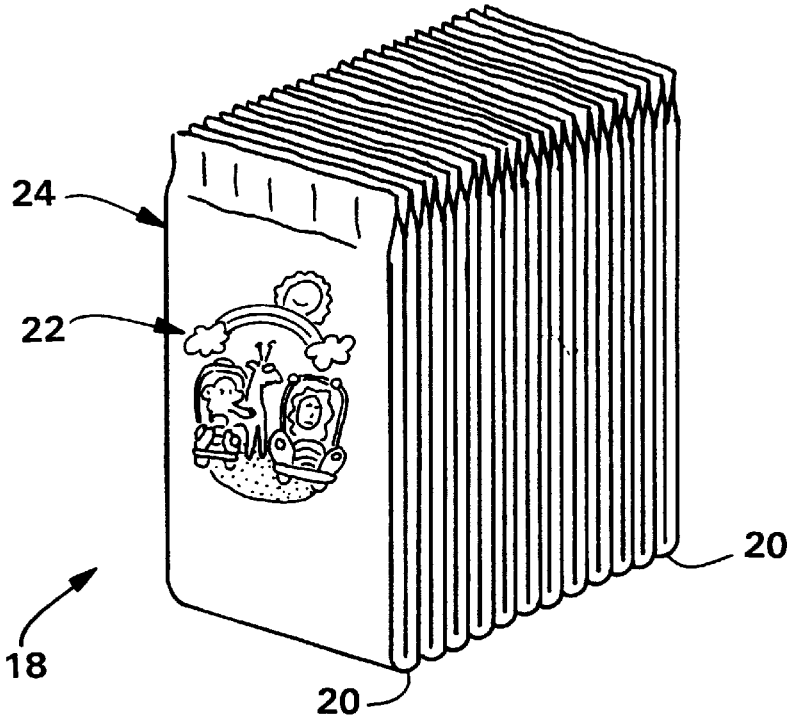
FIG. 10 illustrates a perspective view of a stack of training pants.

Referring to FIGS. 2 and 3, there are illustrated a left-handed bagging machine 10 and a right-handed bagging machine 12. Use of the terms "left-handed" and "right-handed" is only for comparison purposes. Both machines include a product chute 14 and a wicket conveyer assembly 16. In each of the product chutes 14 of left-handed bagging machine 10 and right-handed bagging machine 12, there is a stack 18 (FIG. 10) of product, such as, by way of example only, a child's training pant 20 (FIG. 9). One particular style of training pant is disclosed in U.S. Pat. No. 4,940,464, the contents in which are incorporated by reference herein. Each of the training pants 20 has a graphic 22 (FIG. 9) which can be provided on a front panel 24 thereof in any manner known in the art.

Figure 11:
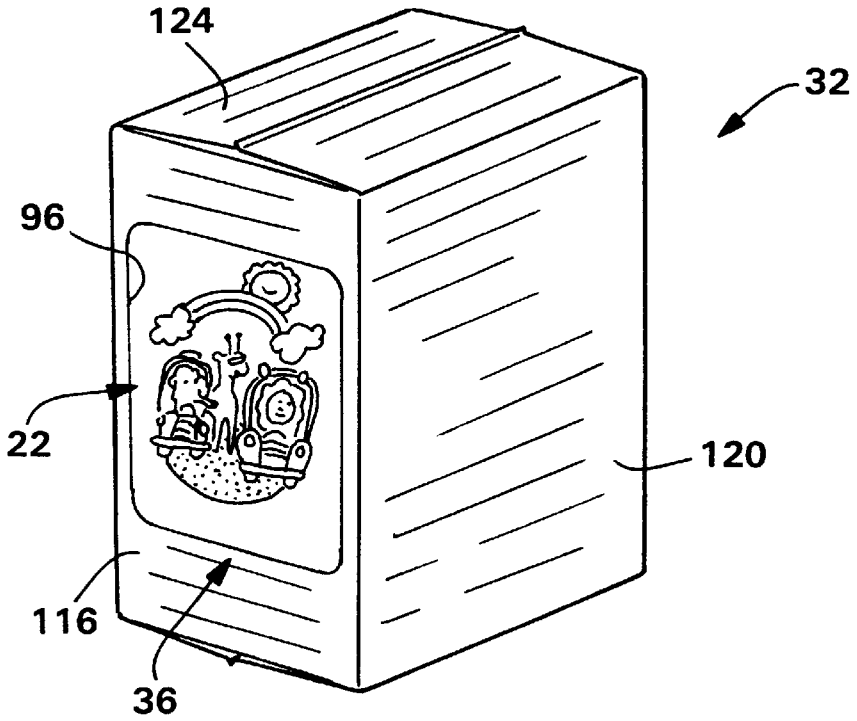
FIG. 11 is a perspective view of a bag comprising a bag window and filled with a stack of training pants in which a graphic of one training pant is visually perceivable through the window.

Continuing to refer to FIGS. 2 and 3, each wicket conveyer assembly 16 moves in the same direction as illustrated by arrows 26, 28, and both assemblies 16 move a plurality of wickets 30, in which each wicket 30 includes a plurality of unfilled flexible packaging bags 32. Each flexible packaging bag 32 includes a bag opening 34 (FIG. 1) for receiving a stack 18 of training pants, and a bag window 36 through which a graphic 22 will be visually perceivable after a bag 32 is appropriately opened, filled, and sealed (FIG. 11). For left-handed bagging machine 10, the wicket conveyer assembly 16 is oriented to move in the direction of arrow 26 such that, upon filling a bag 32 with a stack 18 of training pants, a graphic 22 will be visually perceivable through a bag window 36. As described hereafter, each machine 10, 12 includes a filler plate 38 and a reciprocative filler arm 40 for moving or pushing a stack 18 through bag opening 34 (FIG. 1) and into a bag 32.

Figure 1:
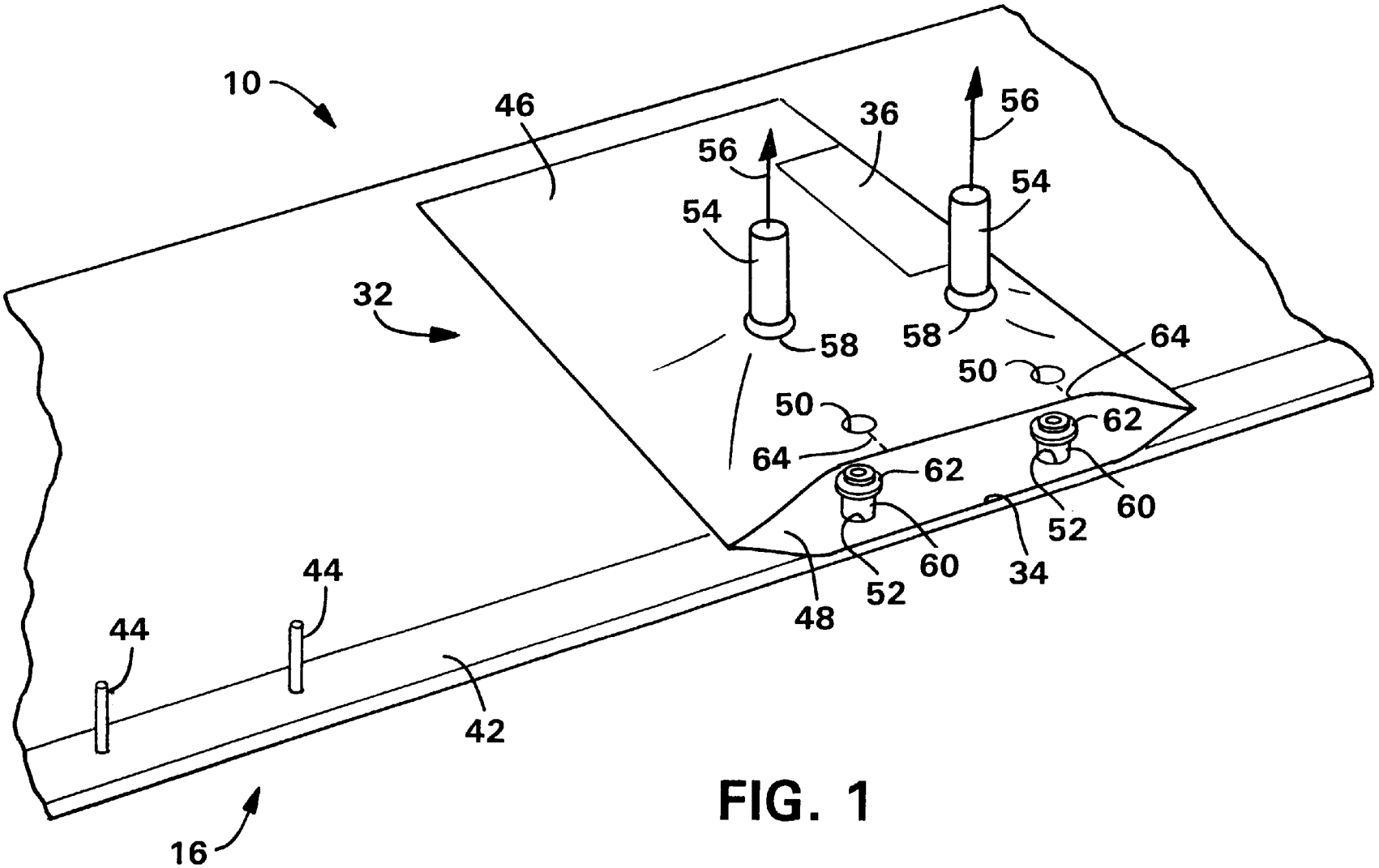
FIG. 1 illustrates a fragmentary perspective view of a portion of a bagging machine with a known bag thereon.

Referring now to FIG. 1, there is illustrated a fragmentary portion of a wicket conveyor assembly 16 for a left-handed bagging machine 10 illustrated in FIG. 2. The wicket conveyor assembly 16 comprises a movable belt or chain 42 having a plurality of pins 44 positioned thereon. The pins 44 can be arranged in pairs in which the pins 44 in a respective pair can be spaced apart approximately 2 inches for a left-handed bagging machine 10. Optionally, there can be a plurality of pins 44 in which all of the pins can be spaced apart approximately 2 inches. The spacing between pins 44 of a left-handed machine 10 are important, since the distance between pins 44 of a right-handed machine 12 (FIG. 3) can be spaced apart a different distance, such as, by way of example only, approximately 4 inches. As earlier mentioned, this is one of the peculiarities or differences in design between a left-handed bagging machine 10 and a right-handed bagging machine 12. Other structural differences can exist and which are relevant to the present invention.

In FIG. 1, there is illustrated, for purposes of explanation and clarity, only a single flexible packaging bag 32 comprising a bag opening 34 and a bag window 36. One typical flexible packaging bag is that described in U.S. Pat. No. 5,282,687, the contents of which are incorporated by reference herein. Bag 32 further comprises an upper layer 46, a lower layer 48, a pair of openings 50 in upper layer 46 and a pair of openings 52 in lower layer 48. Openings 50 are generally concentrically positioned with openings 52, and have substantially the same diameter. The bag 32 is illustrated in a partially opened condition caused by a pair of vacuum arms 54 suitably connected to a vacuum source 56. The vacuum source 56 creates a vacuum force through a respective vacuum arm 54 and a respective vacuum opening 58 that acts upon, i.e., draws upwardly as viewed in FIG. 1, upper layer 46 in order to open or expand the bag opening 34, so that a stack 18 (FIG. 2) of training pants can be moved or pushed therethrough and into the bag 32. In order to properly fill a bag 32, while upper layer 46 is being drawn or sucked upwardly by vacuum arms 54, the lower layer 48 needs to be maintained in a generally secure and/or generally flat condition relative to upper layer 46 and/or movable belt or chain 42; this is accomplished by spools 60 that are inserted through a first pair of generally concentric openings 50, 52 and a second pair of generally concentric openings 50, 52. Each spool 60 comprises a head 62 that has a diameter greater than the diameters of openings 50, 52. The upper layer 46 further includes a release path 64 extending between each opening 50 and bag opening 34. The release path 64 can take any suitable form, such as a line of perforations, a weakened line, or the like, and each release path 64 is sufficiently weakened so that the force created by vacuum source 56 through vacuum arms 54 and vacuum openings 56 is capable of tearing or separating upper layer 46 along release paths 64 to allow upper layer 46 to move upwardly and beyond spool heads 62. In other words, upon being drawn upwardly, that part of upper layer 46 formed with a release path 64 will tear or separate so that the smaller diameter opening 50 can be separated or moved upwardly from a respective spool head 62. As described, a plurality of bags 32 in a wicket 30 works satisfactorily with a left-handed machine 10, since the orientation of bag window 36 permits a graphic 22 (FIG. 2) to be visibly perceived through bag window 36 when the stack 18 is inserted therein, as illustrated in FIG. 11.

With reference now to FIG. 3, the right-handed bagging machine 12 includes a wicket conveyer assembly 16 for conveying the wicket 30 of bags 32 for the loading of individual bags 32 with a stack 18 of training pants 20 having graphics 22. In the design of each bag 32, the release paths 64 are disposed on the upper layer 46 resulting in, when this particular wicket 30 of bags is positioned on pins 44 of a right-handed bagging machine 12 (FIG. 3), each bag window 36 being oriented in a direction opposite from a graphic 22. In viewing FIGS. 2 and 3, it is seen that a bag window 36 in FIG. 3 will not permit a graphic 22 to be visually perceived therethrough, since a window 36 and a graphic 22 face in opposite directions. This cannot be corrected by turning the wicket 30 in FIG. 3 upside down, since that makes upper layer 46 a lower layer having the release paths on the lower layer and, with the lower layer 48 acting as the upper layer but without the release paths 64, prevents the vacuum arms 54 from raising or separating the uppermost layer from the spool heads 62. This is one of the problems overcome by the present invention.

The present invention is also less costly than other solutions, such as providing additional machinery in a right-handed bagging machine 12 that would take each stack 18 of training pants and reverse the stack 180° so that the graphic 22 faces an opposite direction from that illustrated in FIG. 3. Although this would solve the problem, it would be costly in terms of purchasing additional machinery and machinery maintenance. The present invention easily and in a less costly manner solves the above-described problem.

Although the above description focuses on the problem of a bag with a window and a graphic to be viewed or seen through the window, there can be other obstacles to the use of known bags on differently designed bagging machines. Thus, the window-graphic description is only representative of problems addressed by the present invention.

Figure 4:
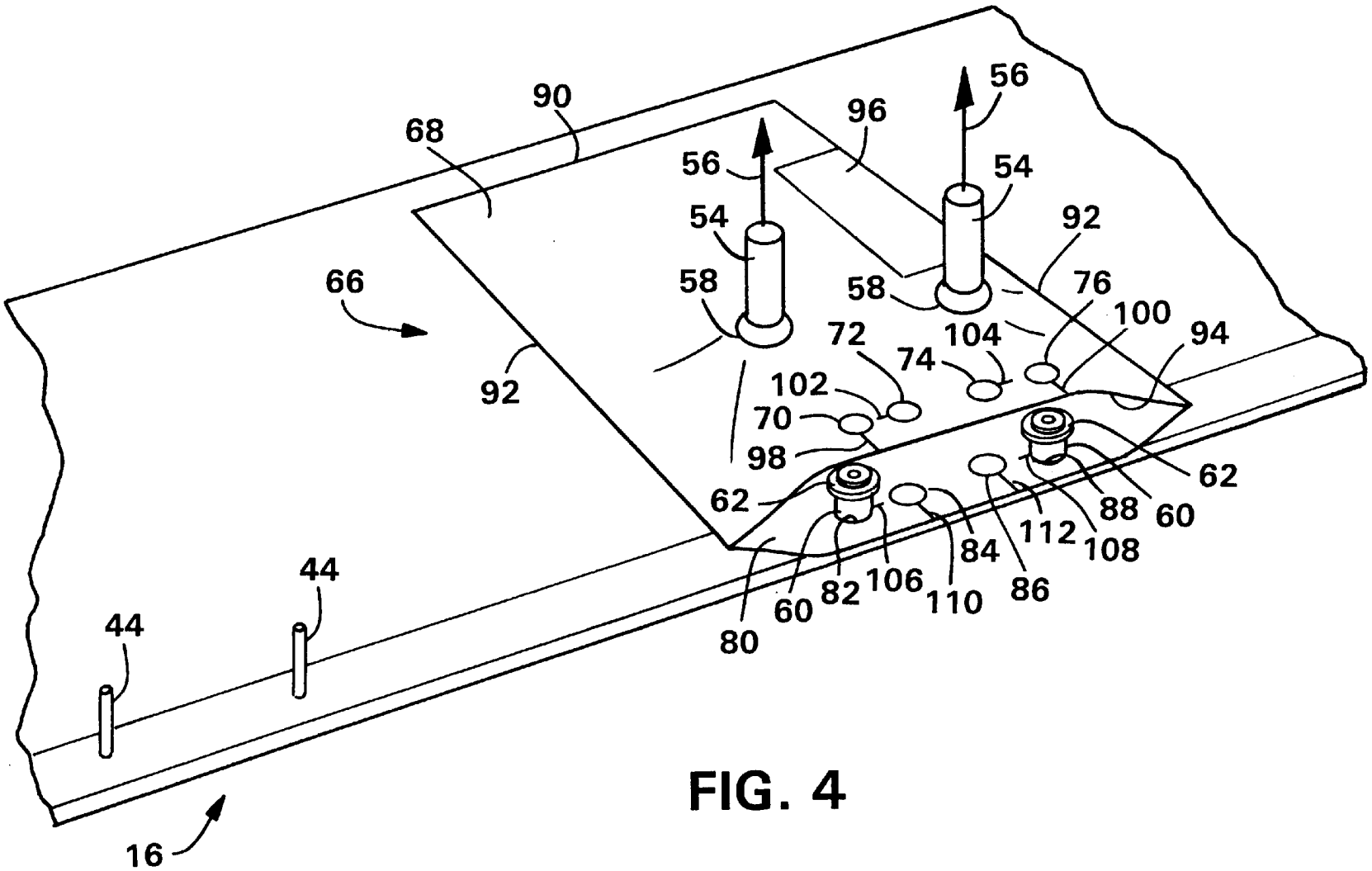
FIG. 4 illustrates a fragmentary perspective view of a portion of a bagging mechanism with one embodiment of the present invention.

Referring now to FIG. 4, there is illustrated a flexible packaging bag 66 of the present invention in a partially opened condition. The flexible packaging bag 66 comprises a top layer 68 which includes four holes 70, 72, 74, 76 positioned in top layer 68 to form an outer pair of holes 70, 76 and an inner pair of holes 72, 74. Similarly, a bottom layer 80 includes four holes 82, 84, 86, 88 that are positioned to form an outer pair of holes 82, 88, and an inner pair of holes 84, 86. Bag 66 includes a closed end 90, a pair of closed sides 92, and a bag opening 94. A bag window 96 is positioned, i.e., manufactured in any suitable manner known in the art, partially in top layer 68 and partially in bottom layer 80, such that bag window 96 wraps around the closed side 92 in the right hand portion of FIG. 4. The top layer 68 also includes a pair of slits 98, 100 extending between holes 70, 76, which is the outer pair of holes for top layer 68, and bag opening 94. Thus, slit 98 extends between hole 70 and bag opening 94, and slit 100 extends between hole 76 and bag opening 94. A pair of tear notches 102, 104 are associated with the inner pair of holes 72, 74 of top layer 68 and are directed toward the outer pair of holes 70, 76. The term "associated" refers to the tear notches, or any other similar device, causing or allowing top layer 68 to begin tearing in a direction from hole 72 towards hole 70, and from hole 74 towards hole 76.

Referring now to bottom layer 80 in FIG. 4, layer 80 includes a pair of tear notches 106, 108 associated with its outer pair of holes 82, 88 and which are directed toward the inner pair of holes 84, 86. Layer 80 also includes slits 110, 112, in which slit 110 extends between hole 84 and bag opening 94, and slit 112 extends between hole 86 and bag opening 94.

Although the top layer 68 has been described above as having slits 98, 100 extending between the outer pair of holes 70, 76, and having tear notches 102, 104, associated with the inner pair of holes 72, 74, the present invention contemplates the top layer 68 and bottom layer 80 as interchangeable, such that top layer 68 can have slits 98, 100 extending between the inner pair of holes 72, 74 and the bag opening 94, and can have tear notches 102, 104 associated with the outer pair of holes 72, 76 and directed toward the inner pair of holes 72, 74. Similarly, bottom layer 80 can have its slits 110, 112 and tear notches 106, 108 in a reverse orientation, such that slits 110, 112, extend between the outer pair of holes 82, 88 and the bag opening 94, and the tear notches 106, 108 can be associated with the inner pair of holes 84, 86 and directed toward respective holes 82, 88.

As can be seen in FIG. 4, the holes are generally concentrically positioned, such that hole 70 and hole 82 are generally concentric, hole 72 and hole 84 are generally concentric, hole 74 and hole 86 are generally concentric, and hole 76 and hole 88 are generally concentric. If, for example, and as illustrated in FIG. 4, the outer pair of holes 70, 76 of top layer 68 have slits 98, 100, then their corresponding and concentric holes 82, 88 in bottom layer 80 will have tear notches 106, 108 associated therewith and directed towards the inner pair of holes 84, 86. The same pertains to the tear notches 102, 104 in top layer 68 in that holes 84, 86 in bottom layer 80 will have slits 110, 112. Thus, in any pair of generally concentric holes, such as, by way of example only, hole 70 and hole 82, each hole will be differently designed or provided such that when one of the holes has a slit or a tear notch, the other hole will have the other of a slit or tear notch. In other words, any pair of generally concentric holes, such as holes 70, 82, will be different in terms of having either a slit or a tear notch, and this is clearly illustrated in FIG. 4. Thus, whenever the outer pair of holes 70, 76 of top layer 68 have slits 98, 100, then the outer pair of holes 82, 88 in the bottom layer 80 will have tear notches 106, 108; and, should the outer pair of holes 70, 76 have tear notches 102, 104, then the outer pair of holes 82, 88 will have slits 110, 112. This also applies to the inner pair of holes 72, 74 of top layer 68 and the inner pair of holes 84, 86 in bottom layer 80.

Referring to FIG. 4, those elements that are common with the above description relating to FIGS. 1–3 will have the same reference numerals. For example, FIG. 4 illustrates the wicket conveyer assembly 16 having a plurality of pins 44 onto which a wicket (not illustrated in FIG. 4) can be positioned. A vacuum source, or sources, 56 provide a vacuum force through vacuum arms 54 and vacuum openings 58 in order draw top layer 68 upwardly, thereby opening bag opening 94. For purposes of clarity and understanding of the present invention, there is illustrated only a single flexible packaging bag 66 in FIG. 4. During normal operations, there would be a wicket of bags 66 disposed on a pair of pins 44, and this will be more clearly described with reference to FIGS. 5–7 hereafter.

Figure 6:
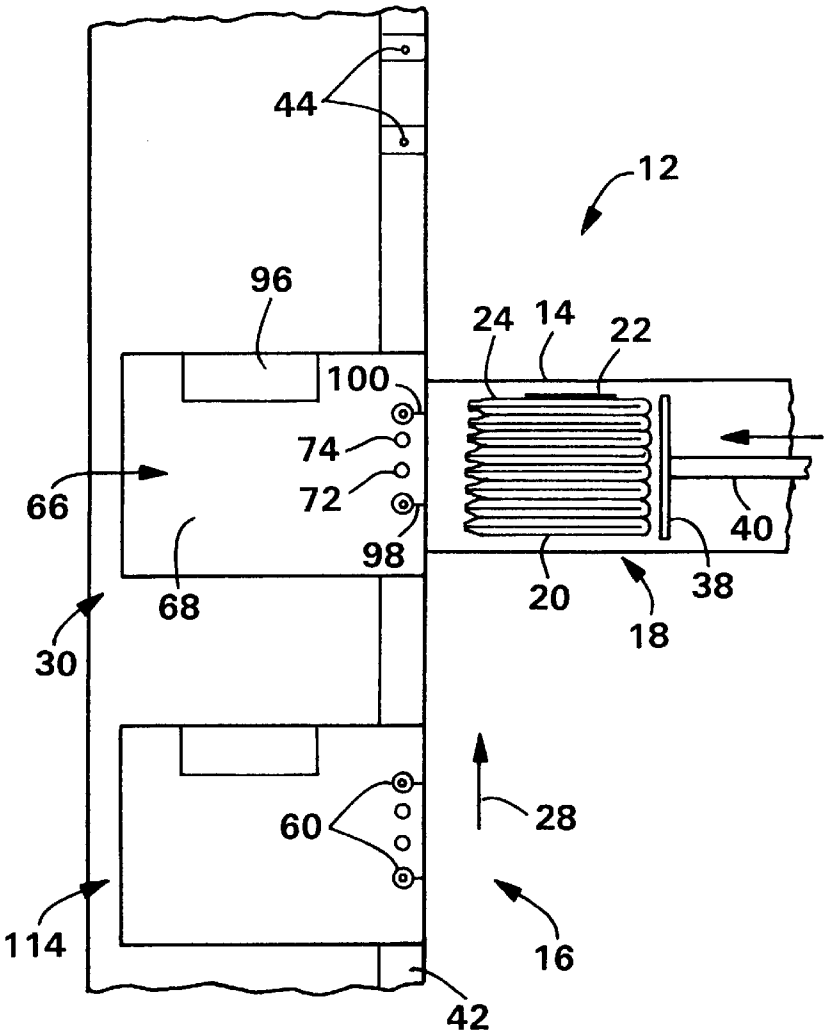
FIG. 6 illustrates a fragmentary top elevational view of a right-handed bagging machine with the bag of FIG. 4.

Illustrated in FIG. 4 is a portion of a right-handed bagging machine 12, such as that illustrated in FIG. 6. The right-handed bagging machine 12 in FIG. 6 includes a plurality of pins 44 that are spaced apart approximately 4 inches for this type of machine, which is in contrast to the left-handed bagging machine 10 of FIG. 5 in which the pins 44 are spaced apart approximately 2 inches; this is one of the design peculiarities that can exist between different types of bagging machines which the present invention addresses. In FIG. 6, a wicket 114 of flexible packaging bags 66 moves in an upward direction, as viewed in FIG. 6 and represented by arrow 28. Since the right-handed bagging machine 12 has pins 44 spaced apart approximately 4 inches, spools 60 (FIG. 4) are received in the outer pair of holes 70, 76 of top layer 68 and the outer pair of holes 82, 88 of bottom layer 80. Referring now to both FIGS. 4 and 6, as the wicket 114 proceeds upwardly, as illustrated in FIG. 6, it is brought into alignment with product chute 14 and stopped at that point so that the plurality of flexible packaging bags 66 can be loaded sequentially with the stack 18 of products. In this particular description, the products will include a plurality of training pants 20 (FIG. 9) having graphics 22 positioned on their respective front panels 24. The movement of a wicket 114 through this process is accomplished by machinery and processes well known in the art of filling flexible packaging bags with articles. Thus, any suitable mechanism can be used or adapted for use with the present invention. Once a wicket 114 is in alignment with product chute 14, vacuum source 56 (FIG. 4) provides a vacuum through a respective vacuum arm 54 and vacuum opening 58 in order to draw top layer 68 upwardly, and this is shown in FIG. 4 in which top layer 68 begins to move upwardly and at the same time begins to open bag opening 94. Since the outer pair of holes 70, 76 of top layer 68 have respective slits 98, 100, top layer 68 will separate adjacent bag opening 94 from spools 60, since the material of which top 68 is made easily separates along the slits 98, 100, thereby allowing top layer 68 to separate also from spool heads 62. Still referring to FIG. 4, the outer pair of holes 82, 88 of bottom layer 80 do not have any slits, such as holes 70, 76, and thus bottom layer 80 is maintained securely fixed or positioned on spools 60. Any significant upward movement of bottom layer 80 is prevented because of spool heads 62, which have a diameter greater than the diameter of the outer pair of holes 82, 88. This permits the top layer 60 to be fully opened so that the stack 18 (FIG. 6) of training pants 20 can be moved through bag opening 94 by the action of filler plate 38 and filler arm 40. As earlier mentioned, the sequential operation of moving a wicket 114 into alignment with product chute 14, the opening of bags 66, and the filling of bags 66 with stacks 18 of training pants 20 are well known in this particular art.

Figure 7:
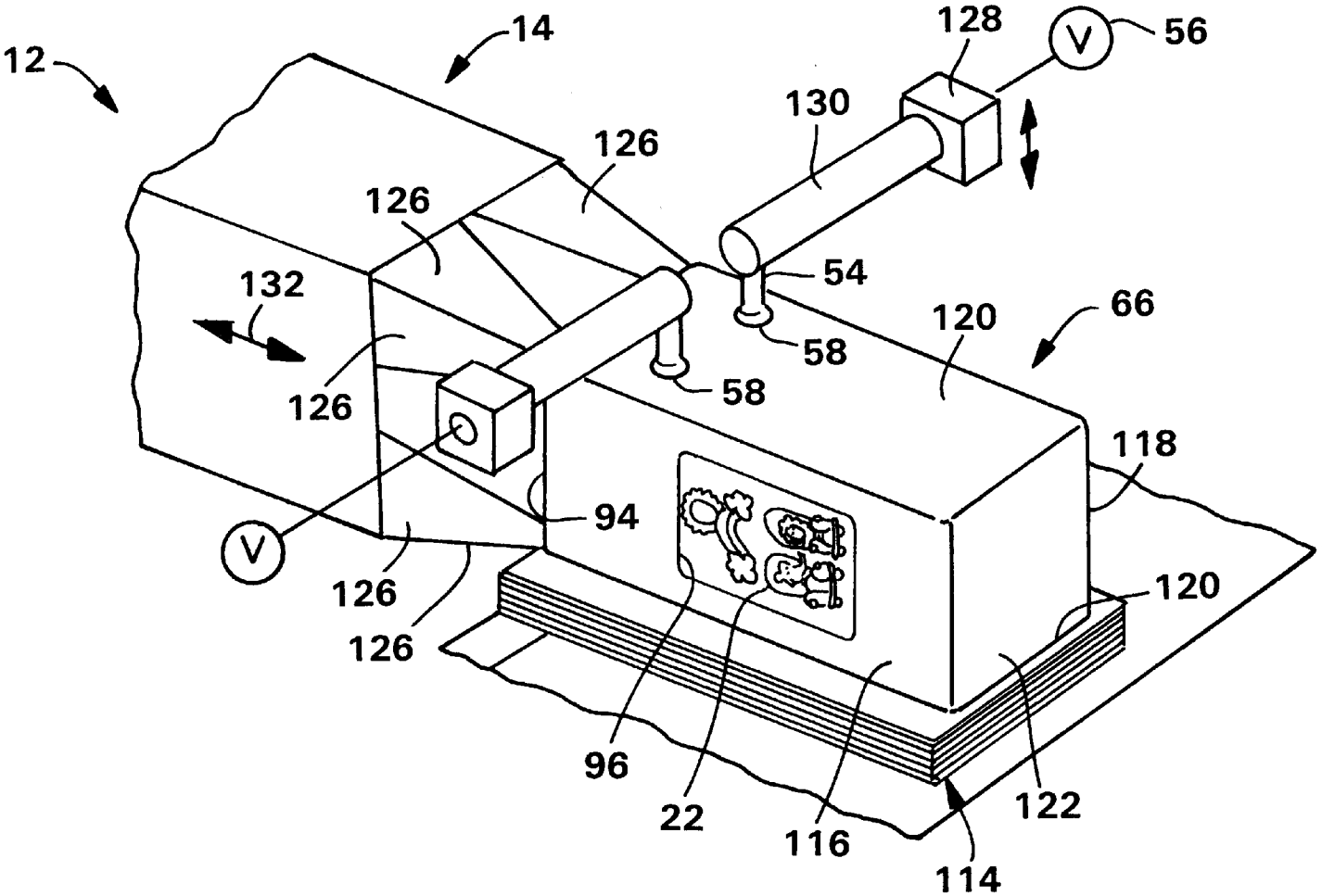
FIG. 7 illustrates a fragmentary perspective view of a bagging machine with a wicket of bags in FIG. 4.

Referring now to FIG. 7, which is a side view from an opposite direction of the right-handed machine in FIG. 6, a single flexible packaging bag 66 is illustrated being filled with a stack 18 (FIG. 6) of training pants 20. The dual action of bag opening 94 (FIG. 4) being fully opened and a stack 18 (FIG. 6) being moved or pushed through bag opening 94 results in packaging bag 66 taking the shape of a polyhedral comprises a front wall 116, which includes the bag window 96 and a graphic 22 visually perceived therethrough, a back wall 118 a pair of side walls 120, a bottom wall 122, and eventually a top wall 124 (FIG. 11). Bag opening 94 is fully opened under the influence of vacuum source 56 providing an opening or drawing force through a coupling device 128, a vacuum tube 130, and vacuum arm 54, as well as a plurality of moveable spreader plates 126 that are operatively associated with machine 12 (FIG. 6). The movable spreader plates 126 are initially together in a converging manner, such that they can be easily inserted into the bag opening 94 which is just beginning to be fully opened, as illustrated in FIG. 4. Once the movable spreader plates 126 have been inserted, they are then spread apart in a diverging manner in order to fully open bag opening 94, thereby beginning to define the polyhedral shape of a flexible packaging bag 66 as illustrated in FIG. 7. The movable spreader plates 126 are moved in a reciprocative manner, as illustrated by arrow 132. After the bag 66 has been filled with the stack 18 (FIG. 6) of training pants 20, it is then moved or pushed away from product chute 14 for subsequent handling operations that include the closing of bag opening 94 in order to seal and form top wall 124 (FIG. 11). Once a filled bag 66 has been moved or pushed off a wicket 114, the next flexible packaging bag 66 is then opened and filled in a similar manner.

Referring now to FIGS. 4 and 7, once a bag 66 has been filled, it must be separated from spools 60 so that it may be moved to the next handling operation. The separation of bottom layer 80 is accomplished in part by filler plate 38 (FIG. 6) and filler arm 40 which, in moving or pushing a stack 18 through bag opening 94 (FIG. 7), forcibly move or push bag 66 in a right-to-left direction, as viewed in FIG. 6, in order to tear the bag material of bottom layer 80 adjacent the outer pair of holes 82, 88. The tearing of bottom layer 80 under a substantially constant force is initiated at and assisted by tear notches 106, 108 so that tear lines will propagate from hole 82 toward an inner hole 84 and from hole 88 toward inner hole 86. One purpose of this is to prevent a piece of plastic material, of which bottom layer 80 is made, being separated from the bag and becoming mixed with the product in the bag, from becoming lodged in the machinery, or the like.

Figure 5:
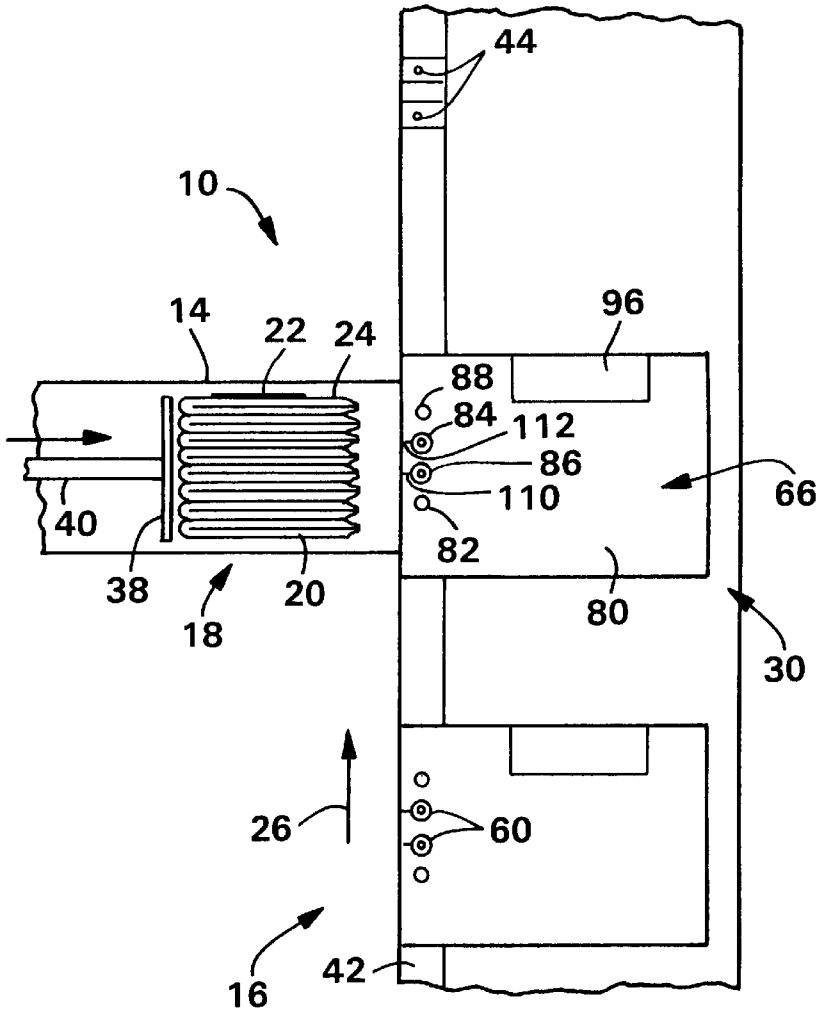
FIG. 5 illustrates a fragmentary top elevational view of a left-handed bagging machine with the bag of FIG. 4.

Referring now to FIG. 5, the left-handed bagging machine 10 is illustrated with a wicket 114 of bags 66 in which the wicket has been turned upside down, from its orientation in FIG. 6, in order to properly align or match a bag window 96 with a graphic 22 in the stack 18 of training pants 20. A single flexible packaging bag 66 is filled with a stack 18 of training pants 20 by left-handed bagging machine 10 in a manner similar to that of right-handed bagging machine 12. Thus, a bottom layer 80 of a bag 66 is moved or lifted upwardly by a vacuum source, vacuum arm, and vacuum opening similar or identical to those in FIG. 4. Because the pins 44 of a left-handed bagging machine 10 can be spaced apart approximately 2 inches, it is the inner pair of holes 84, 86 (FIG. 4) of bottom layer 80 and the inner pair of holes 72, 74 (FIG. 4) of top layer 68 that have spools 60 received therethrough. In FIG. 5, it can be seen that that the inner pair of holes 84, 86 have slits 110, 112 so that bottom layer 80 can be easily separated and lifted above spool heads 62. The filling of bag 66, and its separation from spools 60 is identical to that earlier described with reference to FIG. 6 and right-handed bagging machine 12. As bag 66 is filled and then moved or pushed away from spool 60, tear notches 102, 104 (FIG. 4) direct the tear propagation from the inner pair of holes 72, 74 to respective ones of the outer pair of holes 70, 76.

In viewing both FIGS. 5 and 6, it can now be understood that the operator who places a wicket 114 of bags 66 on a bagging machine need only identify the side on which a graphic 22 is visible on a stack 18, and then position the wicket 114 such that the bag windows 96 are on the same side as the graphic 22. Thus, a wicket 114 of bags 66 can be used on a right-handed machine 12 and, if desired, need only be reversed or turned over in order to be used on a left-handed bagging machine 10. This operation may also require the operator to reposition spools 60 so that they are received in the proper pair of holes for the particular bagging machine used.

As described, it is now evident that the present invention has provided a solution to the problem of differently designed bagging machines in which, by way of example only, the pins 44 are separated by a different distance, the orientation of wicket conveyor assemblies 16 is different, or the like. Another advantage of the present invention is that there is no requirement now for manufacturing and procuring dual inventories of bags, in which one inventory is for right-handed bagging machines and the other inventory for the left-handed bagging machines.

The manufacturing or making of a flexible packaging bag 66 of the present invention, in one method, includes providing a top layer 68 with an outer pair of holes 70, 76 and an inner pair of holes 72, 74 in the top layer 68, providing a bottom layer 80 with an outer pair of holes 82, 88 and an inner pair of holes 84, 86 in the bottom layer 80, providing a bag opening 94, providing a bag window 96, slitting the top layer between the outer pair of holes and the bag opening to form slits 98, 100, and notching the inner pair of holes 72, 74 to form tear notches 102, 104 in top layer 68. The method further includes slitting the bottom layer 80 between the inner pair of holes 84, 86 and the bag opening 94 to form slits 110, 112, and notching the outer pair of holes 82, 88 to form tear notches 106, 108 in bottom layer 80. The notching of the holes is done in a fashion or manner that includes directing the notching toward the other pair of holes. The providing of the holes in top layer 68 and bottom layer 80 is accomplished in a manner such that the holes are generally concentrically related, as illustrated in FIG. 4. The method also includes positioning the bag window partially in the top layer and partially in the bottom layer as illustrated in FIG. 4. As earlier mentioned, although the description refers to a specific bottom layer and top layer, it should be understood that the present invention contemplates these layers to be reversible in handling the bags and filling the bags with product.

Figure 8:
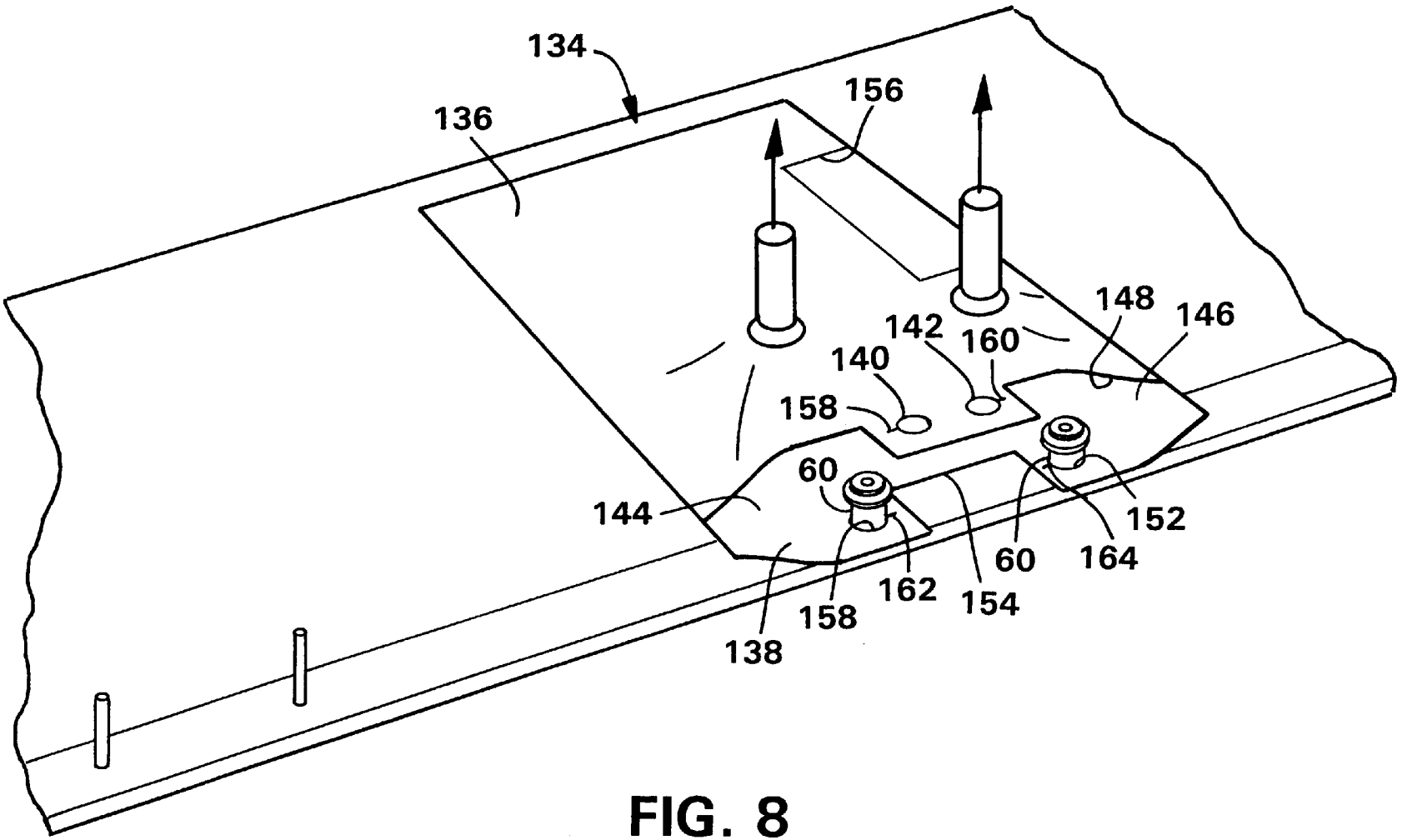
FIG. 8 illustrates a fragmentary perspective view of a bagging machine with another embodiment of the present invention.

Referring to FIG. 8, another embodiment of the present invention is illustrated as a flexible packaging bag 134 comprising a top layer 136 and a bottom layer 138. The top layer 136 includes a pair of holes 140, 142 that are spaced apart a first distance, such as by way of example only, approximately 2 inches, and a pair of corner cutouts 144, 146 adjacent bag opening 148. The bottom layer 138 includes a pair of holes 150, 152 that are spaced apart a second distance, such as by way of example only, approximately 4 inches, and a cutout 154 intermediate holes 150, 152 and adjacent bag opening 148. As with bag 66, bag 134 includes a bag window 156 positioned partially in top layer 136 and partially in bottom layer 138, as viewed in FIG. 8. The holes 140,142 of top layer 136 have respective tear notches 158, 160 associated therewith and directed toward respective ones of the corner cutouts 144, 146. Similarly, holes 150, 152 of bottom layer 138 have tear notches 162, 164 associated therewith and directed toward the intermediate cutout 154. The pair of holes 140, 142 of top layer 136 are positioned between the pair of holes 150, 152 of bottom layer 138 as viewed in FIG. 8. A wicket of flexible packaging bags 134 can be used on a left-handed or a right-handed bagging machine in a manner similar to that of flexible packaging bag 66 described above.

A flexible packaging bag 134 can be manufactured or made in one method that includes providing a top layer 136, providing a bottom layer 138, providing a bag opening 148, positioning a bag window 156 partially in the top layer and partially in the bottom layer, spacing apart a pair of holes 140, 142 in the top layer a first distance, cutting in the top layer corner cutouts 144, 146 adjacent the bag opening, spacing apart a pair of holes 150, 152 in the bottom layer a second distance greater than the first distance, and cutting in the bottom layer a cutout 154 between the pair of holes 150, 152 and adjacent the bag opening. The method can also include directing the notching toward the cutouts, and positioning the pair of holes of the top layer between the pair of holes of the bottom layer.

While this invention has been described as having a preferred embodiment, it will be understood that it is capable of further modifications. It is therefore intended to cover any variations, equivalents, uses, or adaptations of the invention following the general principles thereof, and including such departures from the present disclosure as come or may come within known or customary practice in the art to which this invention pertains and falls within the limits of the appended claims.

What is claimed is:

1. A flexible packaging bag comprising:

a top layer, a bottom layer, a bag opening, and a bag window positioned partially in said top layer and partially in said bottom layer, said top layer comprising a pair of holes spaced apart a first distance, and a pair of corner cutouts adjacent said bag opening, said bottom layer comprising a pair of holes spaced apart a second distance greater than said first distance, and a cutout adjacent said bag opening and between said pair of holes.

2. The bag of claim 1 wherein said top layer further comprises tear notches associated with said pair of holes and directed toward respective ones of said corner cutouts.

3. The bag of claim 1 wherein said bottom layer further comprises tear notches associated with said pair of holes and directed toward said cutout.

4. The bag of claim 1 wherein said pair of holes of said top layer are positioned between said pair of holes of said bottom layer.

5. A flexible packaging bag, comprising:

a top layer and a bottom layer, a bag opening, and a bag window, one of said top layer and said bottom layer comprising a pair of holes spaced apart a first distance and corner cutouts adjacent said bag opening, the other of said top layer and said bottom layer comprising a pair of holes spaced apart a second distance and a cutout between said pair of holes, wherein said second distance is greater than said first distance.

6. The bag of claim 5 wherein said one of said top layer and said bottom layer further comprises tear notches associated with said pair of holes.

7. The bag of claim 6 wherein said tear notches are directed toward respective ones of said corner cutouts.

8. The bag of claim 5 wherein said other of said top layer and said bottom layer further comprises tear notches associated with said pair of holes.

9. The bag of claim 8 wherein said tear notches are directed toward said cutout.

* * * * *